US005813136A

United States Patent [19]

Meschenmoser

[11] Patent Number: 5,813,136

[45] Date of Patent: Sep. 29, 1998

[54] MACHINE FOR PRODUCING A SHEET OF MATERIAL BY DIRECT PRESS TO DRYER PASSAGE

[75] Inventor: Andreas Meschenmoser, Horgenzell, Germany

[73] Assignee: Voith Sulzer Papiermaschinen GmbH, Heidenheim, Germany

[21] Appl. No.: 791,475

[22] Filed: Jan. 27, 1997

[30] Foreign Application Priority Data

Jan. 25, 1996 [DE] Germany ..... 196 02 492.7

[51] Int. Cl.[6] ..... D21F 5/00

[52] U.S. Cl. ..... 34/446; 34/117; 34/120

[58] Field of Search ..... 34/558, 71, 94, 34/95, 110, 111, 112, 114, 117, 118, 120, 126, 624, 625, 626, 445, 446, 447; 100/83, 86, 88, 93 RP; 162/206, 207, 358.1, 359.1

[56] References Cited

U.S. PATENT DOCUMENTS

| | | | |
|---|---|---|---|
| 2,448,295 | 8/1948 | Bratton . | |
| 4,815,220 | 3/1989 | Wedel | 34/117 X |
| 4,918,836 | 4/1990 | Wedel | 34/117 X |
| 5,120,400 | 6/1992 | Laapotti | 162/206 |
| 5,232,555 | 8/1993 | Daunnais et al. | 34/117 X |
| 5,355,593 | 10/1994 | Kotischke | 34/117 |
| 5,505,006 | 4/1996 | Wulz et al. | 34/117 |
| 5,551,164 | 9/1996 | Brunmair et al. | 34/117 |
| 5,592,751 | 1/1997 | Guggemos et al. | 34/120 X |
| 5,659,976 | 8/1997 | Klockenkemper et al. | 34/114 X |

FOREIGN PATENT DOCUMENTS

| | | |
|---|---|---|
| 3339255 | 5/1984 | Germany . |
| 9012151 | 10/1990 | WIPO . |

OTHER PUBLICATIONS

German Office Action in connection with German Application No. 196 02 492.7–27.

*Primary Examiner*—Henry A. Bennett
*Assistant Examiner*—Steve Gravini
*Attorney, Agent, or Firm*—Greenblum & Bernstein, P.L.C.

[57] ABSTRACT

A machine for producing a sheet of material, e.g., a paper or cardboard sheet, including a pressing part having at least one pressing device and a dryer part that includes a plurality of dryer cylinders. A first dryer cylinder of the plurality of dryer cylinders may be disposed immediately adjacent to the pressing part to form transfer region therebetween. The sheet of material being directly transferred from a press roll of the pressing part to the first dryer cylinder. The first dryer cylinder being heated independently of the other plurality of dryer cylinders at a temperature to form a vapor layer between the first dryer cylinder and the sheet of material.

27 Claims, 1 Drawing Sheet

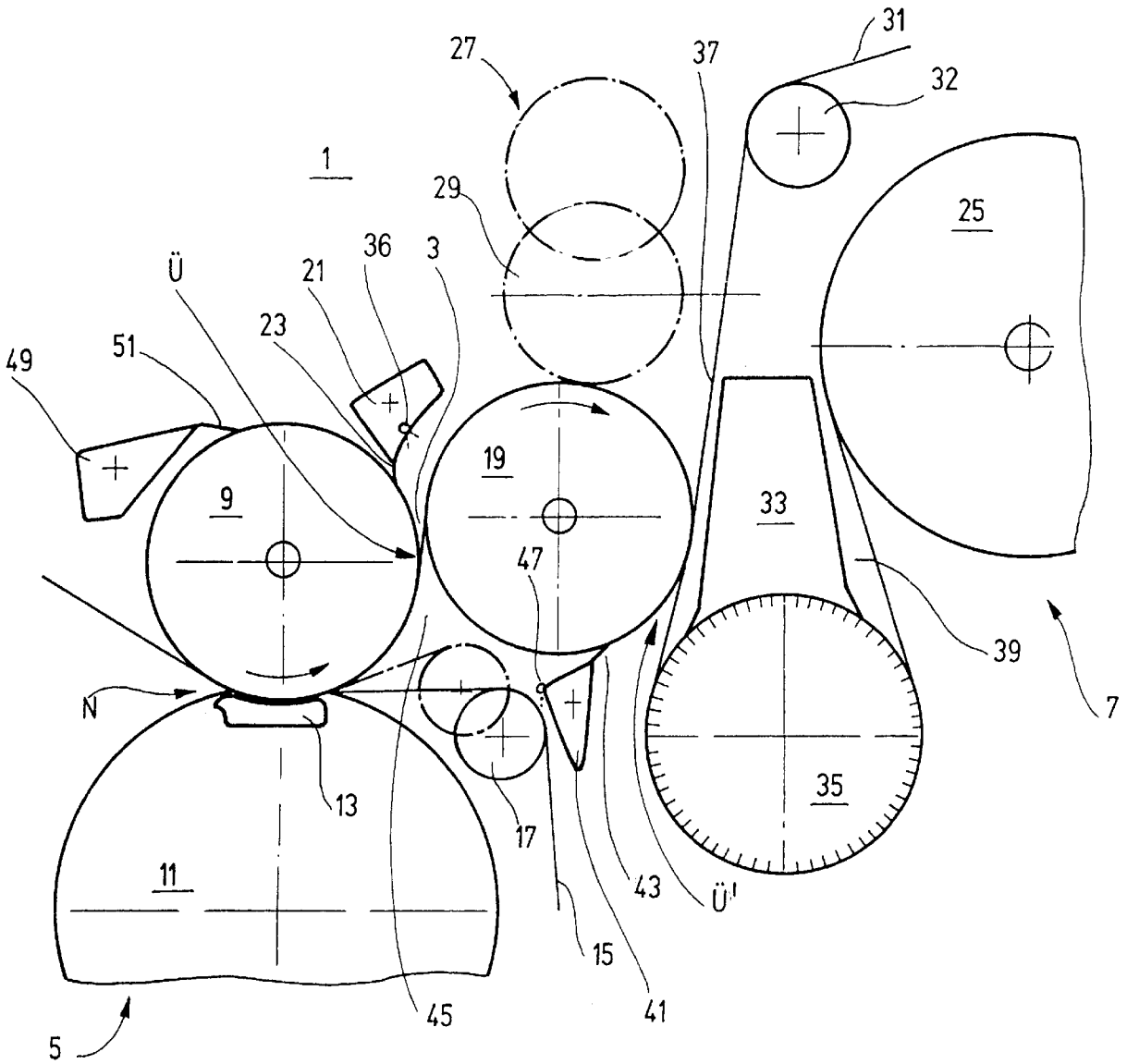
7
25
39
31
32
35
33
37
Ü'
43
41
15
27
29
19
47
17
3
45
36
1
21
23
13
9
Ü
51
11
N
49
5

MACHINE FOR PRODUCING A SHEET OF MATERIAL BY DIRECT PRESS TO DRYER PASSAGE

CROSS-REFERENCE OF RELATED APPLICATIONS

The present invention claims the priority under 35 U.S.C. § 119 of German Patent Application No. 196 02 492.7 filed on Jan. 25, 1996.

BACKGROUND OF THE INVENTION

1. Field of the Invention

The present invention may relate to a machine for producing a web (sheet) of material, e.g., a paper or cardboard sheet. The machine may include a pressing part having at least one pressing device and a dryer part including a plurality of drying cylinders. The first drying cylinder of the dryer part may be positioned following the pressing part in a feed direction.

2. Discussion of the Background Information

Machines generally of the type discussed herein have been discussed, e.g., in WO 90/12151. However, in the prior art device, the desired amount of sheet drying has not been achieved.

SUMMARY OF THE INVENTION

The object of the present invention may be to provide a machine for producing a sheet of material and to provide a method for transferring the produced sheet of material within the machine in a manner that does not suffer the disadvantages of the prior art.

Therefore, the present invention may be directed to a machine for producing a sheet of material. The machine may include a pressing part having at least one pressing device and a dryer part including a plurality of dryer cylinders. The first dryer cylinder of the dryer part may be positioned following the pressing part in a feed direction. Because the first dryer cylinder is disposed immediately following the pressing device (in a web feed direction), the sheet drying process can begin directly and immediately after the pressing part and, thus, can consequently improve the performance of the machine.

An exemplary embodiment of the machine of the present invention distinguishes itself over the prior art in that the temperature of the first dryer cylinder may be independently adjusted with respect to the temperature of the other dryer cylinders within the dryer part. Thus, the surface of the dryer cylinder may be very rapidly heated to an evaporation temperature, which translates into an increased drying capacity of the machine while also providing more efficient use of space, i.e., reducing the space requirements for the machine. The machine may be compact and, thus, may have a relatively low purchase cost.

The present invention may also be directed to a process for transferring a sheet of material, e.g., a paper or cardboard sheet, produced in a sheet production machine. The process may include substantially immediately transferring the sheet of material from a press-roll of a pressing part onto a first dryer cylinder of a dryer part. Because the sheet of material may be transferred from the last press-roller of a pressing part immediately onto the first dryer cylinder of a dryer part, drying of the sheet of material may begin very early in the manufacturing process and, thus, may be advantageously optimized.

An exemplary embodiment of the process of the present invention distinguishes itself over the prior art in that a temperature in the first dryer cylinder may be selected such that a vapor layer may be formed between the dryer cylinder and the sheet of material running on it. Consequently, the sheet of material may be prevented from adhering to the surface of the dryer cylinder.

Accordingly, the present invention may be directed to a machine for producing a sheet of material. The machine may include a pressing part having at least one pressing device, and a dryer part including a plurality of dryer cylinders. The plurality of dryer cylinders may include a first dryer cylinder located immediately adjacent to the pressing part in a downstream direction with respect to a direction of sheet travel.

In accordance with a further feature of the present invention, the machine may also include a temperature setting device associated with the first dryer cylinder to adjust the temperature of the dryer cylinder independently of a temperature set for a remainder of the plurality of dryer cylinders.

In accordance with still another feature of the present invention, the first dryer cylinder may include a regulatable drive mechanism.

In accordance with yet another feature of the present invention, the machine may also include a transfer region formed between the at least one pressing device and the first dryer cylinder and a cleaning scraper associated with the first dryer cylinder. The cleaning scraper may be located abuttingly adjacent the first dryer cylinder to prevent air from interfering with a direct transfer of the sheet of material from the press part to the first dryer cylinder.

In accordance with a still further feature of the present invention, the pressing part may include a press felt. Further, the machine may include a guide roll that guides the press felt along a path in a vicinity of the cleaning scraper, the guide roll being radially adjustable. The cleaning scraper may include an air nozzle directing air in a direction of travel for the press felt.

The present invention may also be directed to a process for transferring a sheet of material in a sheet producing machine. The machine may include a pressing part having at least one pressing device, a dryer part including a plurality of dryer cylinders, and a first dryer cylinder located adjacent to the pressing part to form a transfer region. The process may include transferring the sheet of material from a press-roll of a pressing part directly onto a first dryer cylinder of a dryer part.

In accordance with another feature of the present invention, the process may also include heating the first dryer cylinder independently of the plurality of dryer cylinders.

In accordance with still another feature of the present invention, the process may include selecting a predetermined temperature of the first dryer cylinder and forming a vapor layer between an outer surface of the first dryer cylinder and the sheet of material.

In accordance with yet another feature of the present invention, the process may include setting a predetermined differential speed between at least one of the press-roll and the first dryer cylinder and the first dryer cylinder and a subsequent roller of the dryer part.

The present invention may be directed to a machine for producing a web of material. The machine may include a pressing part including a press roll, and a dryer section including a first dryer cylinder and a plurality of other dryer cylinders. The first dryer cylinder may be located adjacent the press roll to form a transfer region.

In accordance with another feature of the present invention, the web of material may be transferred from the press roll to the first dryer cylinder in the transfer region.

In accordance with a further feature of the present invention, the machine may also include a scraper device including a scraper blade and an air nozzle for facilitating a transfer of the web from said press roll to said first dryer cylinder. The scraper blade may be positioned adjacent an outer surface of the press roll and the air nozzle including a variable intensity and directional air jet.

In accordance with a still further feature of the present invention, the machine may also include a scraper device including a scraper blade and an air nozzle to prevent entry of air currents, created by rotation of the first dryer cylinder, into the transfer region.

In accordance with another feature of the present invention, the machine may further include a press felt and at least one guide roll. The pressing part may include a nip and the press felt may guide the web through the nip. The at least one guide roll may separate the web and the press felt after passing through the nip. Further, the at least one guide roll may be positioned adjacent the scraper device and the air nozzle may direct an air jet in a direction of travel of the transfer belt.

In accordance with a further feature of the present invention, the machine may also include a temperature device for setting a temperature of the first dryer cylinder independently of a temperature of the plurality of other dryer cylinders.

In accordance with a still further feature of the present invention, the temperature of the first dryer cylinder is sufficient to form a vapor layer between an outer surface of the first dryer cylinder and the web.

In accordance with yet another feature of the present invention, the machine may further include a screen guiding roll, located between the first dryer cylinder and the plurality of other dryer cylinders, including one of a porous and perforated outer jacket. The machine may also include an endless gas permeable dryer screen to guide the web from the first dryer cylinder to the plurality of other dryer cylinders, the dryer screen guided to abut at least a portion of the first dryer cylinder, and a suction device associated with the screen guiding roll to adhere the web to the dryer screen and to facilitate transfer of the web from the first dryer cylinder to the plurality of other dryer cylinders.

The present invention may also be directed to a method for transferring a sheet of material in a sheet producing machine. The machine may include a pressing device having a nip and at least one press roll, a press felt, a first dryer cylinder, and a plurality of other dryer cylinders. The method may include guiding the sheet of material on the press felt through the nip, separating the sheet of material from the press felt, the sheet of material adhering to the at least one press roll of the press, forming a transfer region between the at least one press roll and the first dryer cylinder, and transferring the sheet of material from the at least one press roll to the first dryer cylinder.

In accordance with another feature of the present invention, the method may also include positioning a scraper device along an outer surface of the at least one press roll, peeling the sheet of material from the at least one press roll with the scraper device, and directing an air jet at the peeled sheet in a direction of the first dryer cylinder.

In accordance with still another feature of the present invention, the method may also include setting a predetermined temperature for an outer surface of the first dryer cylinder, and forming a vapor layer between the sheet of material and the first dryer cylinder in accordance with the predetermined temperature.

In accordance with a further feature of the present invention, the method may include preventing air carried by rotation of the first dryer cylinder from entering the transfer region. To prevent the air from entering the transfer region the method may also include positioning a scraper device along an outer surface of the first dryer cylinder, positioning a guide roll, associated with the press felt that facilitates separation of the sheet of material and the press felt, adjacent to the scraper device, and directing an air jet from the scraper device in a direction of press felt travel.

In accordance with yet another feature of the present invention, the method may also include positioning a dryer screen to at least abut the first dryer cylinder, the dryer screen arranged between the first dryer cylinder and a suction device, transferring the sheet of material from the first dryer cylinder to the dryer screen via suction, and guiding the sheet of material to the plurality of other dryer cylinders.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein:

The drawing FIGURE illustrates a schematic side view of a machine for producing a sheet of material in which a web is transferred from a pressing device to a dryer cylinder.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing making apparent to those skilled in the art how the invention may be embodied in practice.

The machine described hereinbelow may generally be used for producing sheets of material or sheets of fibrous material, e.g., producing a paper or cardboard sheet. The FIGURE illustrates a portion of a machine 1 for producing a sheet of material 3, e.g., a paper manufacturing machine for producing a paper sheet. The portion of machine 1 may include a transition region between a pressing part 5 and a dryer part 7. In the FIGURE, only a last pressing device of pressing part 5 is illustrated, however, it is noted that more than one further similar pressing device may be utilized in pressing part 5. The pressing device may include a press-roll 9 abutting a conventional opposing roll 11. Conventional roll 11 may also include a pressing shoe 13 for exerting a radially outward pressure on roll 11 against press-roll 9. A sheet of material 3 may be guided, with a press felt 15, through a press nip N. Press felt 15 may be utilized to absorb any fluid expressed from the sheet of material when passing through press nip N.

While sheet of material 3 may adhere (or remain stuck) to the outer surface of press-roll 9 as it exits press nip N, press felt 15 may be removed from an outer surface of roll 9 by guiding press felt 15 over a guide roll 17. As shown in the FIGURE, guide roll 17 may be movably mounted within the machine.

A first dryer roll 19 of a dryer part 7 may be disposed in the immediate vicinity of press-roll 9. First dryer roll 19 may remove sheet of material 3 from the outer surface of press-roll 9. In the exemplary embodiment of machine 1 shown in the FIGURE, a transfer scraper device 21 may be provided which has a scraper blade 23 that abuts the outer surface of press-roll 9 and preferably may include a air nozzle 36. Air nozzle 36 may be adjustable to vary an intensity or direction of an air jet. At least during the threading process, transfer scraper device 21 may be used to transport (transfer) sheet of material 3 or a threading strip from press-roll 9 onto first drying cylinder 19.

First drying cylinder 19 may replace the conventional use of guide rolls which are generally disposed adjacently downstream of a pressing part and are generally used to transfer the sheet of material into a dryer part. First drying cylinder 19 may include a diameter larger than the diameters of conventional guide rolls. Thus, first drying cylinder 19 may be more rigid and may distinguish itself as a better unreeling line. A larger bending radius, which may be associated with first drying cylinder 19, may have a positive effect with, e.g., thick sheets of fibrous material.

Because first drying cylinder 19 may be disposed very close to pressing part 5 or its press-roller 9, a very short free web or sheet may be produced in transfer region Ü. After transfer region Ü, guidance of sheet 3 by first drying cylinder 19 may begin, which also begins guidance of sheet 3 through dryer part 7. Thus, in accordance with the present invention, it is possible to run machine 1 at higher speeds without increasing the danger of sheet tears.

First drying cylinder 19 may be heated independently of other drying cylinders of dryer part 7. For clarity only a second dryer cylinder 25 of dryer part 7 is shown in the FIGURE. However, it is contemplated that the dryer part 7 may include additional dryer cylinders. The outer surface of first drying cylinder 19 may be set to as high a temperature as possible such that an evaporation temperature, at the surface of sheet of material 3, may be achieved as rapidly as possible. By achieving the evaporation temperature as rapidly as possible, an increase in a drying capacity of dryer part 7 may be attained while saving space. Further, a vapor layer may be produced due to the high surface temperatures of first drying cylinder 19, i.e., between the outer surface and sheet of material 3. This vapor layer may also prevent sheet 3 from adhering to the outer surface of first dryer cylinder 19.

A drive mechanism of first dryer cylinder 19 may configured to be regulated to set a differential speed at transfer point Ü between press-roll 9 and first drying cylinder 19, and at a transfer point Ü' located between first dryer cylinder 19 and another (or subsequent) region of dryer part 7. The differential speed at transfer point Ü' may be set as a function of a winding angle of a dryer screen 31 abutting at least a portion of the outer surface of drying cylinder 19. The function may include that the differential speed decreases with an increasing winding angle. As such, shear forces acting upon sheet of material 3 may be set to a non-critical amount. In the exemplary embodiment of the FIGURE, dryer screen 31 may wind around (abut) only a small region of the outer surface of first dryer cylinder 19. Thus, according to the present invention, there is a possibility of setting a relatively large differential speed. Adjustability of the differential speed between the transfer points leads to a broader improvement of transfer between pressing part 5 and dryer part 7.

It is shown in the FIGURE, above first drying cylinder 19, a smoothing device 27 may be provided and may include at least one smoothing roll 29. The at least one smoothing roll may be adjustably supported and may be configured as, e.g., as a deflection-controlled smoothing roll having an elastic covering or jacket. Smoothing device 27 may permit a pre-smoothing of sheet of material 3 immediately after sheet 3 has been transferred to first drying cylinder 19.

Dryer screen 31 may guide sheet of material 3 in a meandering (winding) path around the remaining dryer cylinders that comprise dryer part 7. A screen guiding roll 35, which includes porous or perforated jacket, may be utilized in conjunction with a suction box 33 so as to remove sheet of material 3 from first dryer cylinder 19 and enable transfer of sheet 3 to second dryer cylinder 25. That is, a circumferential region of screen guiding roll 35, i.e., the surface around which sheet of material 3 and the conveyor belt 31 are guided, may be acted upon with a vacuum associated with suction box 33 to adhere and stabilize sheet of material 3 to dryer screen 31 where guided around the screen guiding roll 35. Through use of suction box 33, an intermediary space 37, located between suction box 33 and dryer screen 31 running onto screen guiding roll 35, and an intermediary space 39, located between suction box 33 and a strand side of dryer screen 31 running off screen guiding roll 35, may be acted upon by the vacuum in a known manner to reliably hold sheet of material 3 on dryer screen 31. Sheet of material 3 being guided by (abutting) dryer screen 31 within the circumferential region of screen guiding roll 35 may be guided into a region of second drying cylinder 25 to directly contact an outer surface, i.e., be pressed against the outer surface of second dryer cylinder 25, by dryer screen 31. The pressing of sheet of material 3 against the outer surface of second dryer cylinder 25 may ensure optimal heat transfer to sheet 3.

Enlargement (adjustment) of the winding angle of dryer screen 31 on first drying cylinder 19 may be performed to vary a dry content of sheet of material 3 and/or to increase a drying power of dryer part 7. These features may be realized by utilizing, or, optionally, replacing smoothing device 27 with, a guide roll 32. By adjusting a position of guide roll 32, the winding angle created between dryer screen 31 and first dryer cylinder 19 may be variably adjusted to any desired amount. Guide roll 32 may be moved relative to first drying cylinder 19 so that a spacing between an outer surface of guide roll 32 and the outer surface of first dryer cylinder 19 may be, e.g., 5 mm. It is contemplated that guide roll 32 may be adjustably moved during operation of machine 1 so that a flexible adjustment of dry content of the sheet of material may be performed. Thus, a variable winding angle between screen dryer 31 and first drying cylinder 19 may be achieved through an arbitrary positioning of guide roll 32. Thus, a pressing region of sheet of material 3 against first dryer cylinder 19 may be adjusted as a function of desired properties of sheet of material 3.

A direction of rotation of first dryer cylinder 19 may be as indicated by the arrow. Transfer region Ü' may be provided with a cleaning scraper 41 positioned adjacent the outer surface of first drying cylinder 19 and which includes a cleaning blade 43 that abuts the outer surface of first drying cylinder 19. The location of cleaning scraper 41 may also prevent air from the drying cylinder 19 from being carried into an air chamber 45 between first drying cylinder 19 and press-roll 9. That is, cleaning scraper 41 may prevent the introduction of unwanted air into transfer region Ü. Guide roll 17 may be adjustably located adjacent to cleaning scraper 41 so that rotation of press felt 15 around guide roll 17 aspirates air out of air chamber 45. This suction effect can be further intensified by an air nozzle 47, positioned at cleaning scraper 41, which directs an air flow in a travel direction of press felt 15. Air chamber 45 may, e.g., be sealed on the sides of machine 1. Through the use of cleaning scraper 41 and the adjustability of guide roll 17, a vacuum may be built up in air chamber 45 to further encourage sheet of material 3 to release from press-roll 9 and to prevent air from being carried between sheet of material 3 and the outer surface of first drying cylinder 19.

Guide roll 17 may be utilized in two advantageous positions. In a first upper position (shown in broken lines), guide roll 17 encourages transfer of sheet of material 3 from press felt 15 to press-roll 9. In a second lower position, remoistening of sheet 3 may be prevented.

First dryer cylinder 19 may be, e.g., provided with a covering having low adhesion. As a result, the passing or transfer of sheet of material 3 onto the dryer screen 31 of dryer part 7 may be encouraged.

As shown in the FIGURE, an additional scraper, e.g., cleaning scraper 49 having a scraper blade 51, may be provided to adjacent to the outer surface of press-roll 9.

The operation of machine 1, and, in particular, the transfer of sheet of material 3 may explained with reference to the drawing FIGURE. Sheet of material 3 is directly transferred from last press-roll 9 of press part 5 onto first drying cylinder 19 of dryer part 7. Thus, the use of conventional guide rolls is eliminated, and the drying process on sheet of material 3 may begin immediately after press part 5. Preferably, first dryer cylinder 19 may be independently heated with respect to the other drying cylinders of dryer part 7, e.g., through a separate regulation of vapor pressure in first dryer cylinder 19. The evaporation temperature may be rapidly reached on the outer surface of first dryer cylinder 19 through this regulation of vapor pressure. This may also translate into a space savings in which increased drying capacity may be realized while utilizing less space than existing (prior art) dryer parts or paper manufacturing machines.

The rotating speed of first dryer cylinder 19 may be regulated so that a definite differential speed may be produced in transfer regions Ü and Ü'. The transfer of sheet of material 3 from press part 5 to dryer part 7 can be further improved. For example, the differential speeds exhibited at transfer regions Ü and Ü' may be related to particular properties of the sheet of material and to its moisture content. Thus, the present invention ensures reliable transfer of the sheet.

The heat radiated in edge regions of first dryer cylinder 19 may produce a heating of press-roll 9. This may inadvertently result in the edge regions of the sheet of material to be over-dried. This disadvantage may be prevented by associating press-roller 9 with a cooling device that conveys heat away from the edge regions of the press-roll.

Thus, in accordance with the present invention, a reliable transfer of the sheet of material from the press part onto the dryer part can be ensured, even at high speeds. The design of the machine for producing a sheet of material may remain relatively simple and, thus, may be reasonably priced and operatively reliable.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A machine for producing a sheet of material comprising:

a pressing part having at least one pressing device;

a dryer part including a plurality of dryer cylinders;

the plurality of dryer cylinders comprising a first dryer cylinder located immediately adjacent to the pressing part in a downstream direction with respect to a direction of sheet travel.

2. The machine according to claim 1, further comprising a temperature setting device associated with the first dryer cylinder to adjust the temperature of the dryer cylinder independently of a temperature set for a remainder of the plurality of dryer cylinders.

3. The machine according to claim 1, the first dryer cylinder comprising a regulatable drive mechanism.

4. The machine according to claim 1, further comprising:

a transfer region formed between the at least one pressing device and the first dryer cylinder; and a cleaning scraper associated with the first dryer cylinder, the cleaning scraper located abuttingly adjacent the first dryer cylinder to prevent air from interfering with a direct transfer of the sheet of material from the press part to the first dryer cylinder.

5. The machine according to claim 1, the pressing part comprising a press felt.

6. The machine according to claim 5, further comprising a guide roll that guides the press felt along a path in a vicinity of the cleaning scraper of the first dryer.

7. The machine according to claim 5, further comprising a guide roll that guides the press felt near the cleaning scraper, the guide roll being radially adjustable.

8. The machine according to claim 5, the cleaning scraper comprising an air nozzle directing air in a direction of travel for the press felt.

9. A process for transferring a sheet of material in a sheet producing machine, the machine comprising a pressing part having at least one pressing device, a dryer part including a plurality of dryer cylinders, and a first dryer cylinder located adjacent to the pressing part to form a transfer region, the process comprising:

transferring the sheet of material from a press-roll of a pressing part directly onto a first dryer cylinder of a dryer part.

10. The process according to claim 9, heating the first dryer cylinder independently of the plurality of dryer cylinders.

11. The process according to claim 9, selecting a predetermined temperature of the first dryer cylinder; and forming a vapor layer between an outer surface of the first dryer cylinder and the sheet of material.

12. The process according to claim 9, setting a predetermined differential speed between at least one of the press-roll and the first dryer cylinder, and the first dryer cylinder and a subsequent roller of the dryer part.

13. A machine for producing a web of material comprising:

a pressing part comprising a press roll;

a dryer section comprising a first dryer cylinder and a plurality of other dryer cylinders; and said first dryer cylinder located adjacent said press roll to form a transfer region.

14. The machine according to claim 13, the web of material transferred from said press roll to said first dryer cylinder in said transfer region.

15. The machine according to claim 13, further comprising a scraper device including a scraper blade and an air nozzle for facilitating a transfer of the web from said press roll to said first dryer cylinder; and said scraper blade positioned adjacent an outer surface of said press roll and said air nozzle including a variable intensity and directional air jet.

16. The machine according to claim 13, further comprising a scraper device including a scraper blade and an air nozzle to prevent entry of air currents created by rotation of said first dryer cylinder into said transfer region.

17. The machine according to claim 16, further comprising;

a press felt;

at least one guide roll;

said pressing part comprising a formed nip; and said press felt guiding the web through said formed nip and said at least one guide roll separating the web and the press felt after passing through said formed nip.

18. The machine according to claim 17, said at least one guide roll positioned adjacent said scraper device and said air nozzle directing an air jet in a direction of travel of said press felt.

19. The machine according to claim 13, further comprising a temperature device for setting a temperature of said first dryer cylinder independently of a temperature of said plurality of other dryer cylinders.

20. The machine according to claim 19, said temperature of said first dryer cylinder sufficient to form a vapor layer between an outer surface of said first dryer cylinder and the web.

21. The machine according to claim 13, further comprising:

a screen guiding roll, located between said first dryer cylinder and said plurality of other dryer cylinders, including at least one of a porous and perforated outer jacket;

an endless gas permeable dryer screen to guide the web from said first dryer cylinder to said plurality of other dryer cylinders, said endless dryer screen guided to abut at least a portion of said first dryer cylinder; and a suction device associated with said screen guiding roll to adhere the web to said dryer screen and to facilitate transfer of the web from said first dryer cylinder to said plurality of other dryer cylinders.

22. A method for transferring a sheet of material in a sheet producing machine, the machine including a pressing device having a formed nip and at least one press roll, a press felt, a first dryer cylinder, and a plurality of other dryer cylinders, said method comprising:

guiding the sheet of material on the press felt through the formed nip;

separating the sheet of material from the press felt, the sheet of material adhering to the at least one press roll of the press;

forming a transfer region between the at least one press roll and the first dryer cylinder; and transferring the sheet of material from the at least one press roll directly onto the first dryer cylinder.

23. The method according to claim 22, said method further comprising:

positioning a scraper device along an outer surface of the at least one press roll;

peeling the sheet of material from the at least one press roll with the scraper device; and directing an air jet at the peeled sheet in a direction of the first dryer cylinder.

24. The method according to claim 22, said method further comprising:

setting a predetermined temperature for an outer surface of the first dryer cylinder;

forming a vapor layer between the sheet of material and the first dryer cylinder in accordance with the predetermined temperature.

25. The method according to claim 22, said method further comprising:

preventing air carried by rotation of the first dryer cylinder from entering the transfer region.

26. The method according to claim 25, preventing the air from entering the transfer region comprising:

positioning a scraper device along an outer surface of the first dryer cylinder;

positioning a guide roll, associated with the press felt that facilitates separation of the sheet of material and the press felt, adjacent to the scraper device; and directing an air jet from the scraper device in a direction of transfer belt travel.

27. The method according to claim 22, said method further comprising:

positioning an endless gas permeable dryer screen to at least abut the first dryer cylinder, the dryer screen arranged between the first dryer cylinder and a suction device;

transferring the sheet of material from the first dryer cylinder to the dryer screen via suction; and guiding the sheet of material to the plurality of other dryer cylinders.

* * * * *